US005745817A

United States Patent [19]

Yamazaki et al.

[11] Patent Number: 5,745,817

[45] Date of Patent: Apr. 28, 1998

[54] ELECTROPHOTOGRAPHIC APPARATUS AND PAPER DETECTOR THEREOF AND PAPER DETECTING METHOD THEREOF

[75] Inventors: Akihiko Yamazaki, Hitachinaka; Shuho Yokokawa, Mito; Kunitomo Takahashi, Hitachinaka; Youji Hirose, Mito; Hidenori Iwanaga, Hitachinaka, all of Japan

[73] Assignee: Hitachi Koki Co., Ltd., Japan

[21] Appl. No.: 745,053

[22] Filed: Nov. 7, 1996

[30] Foreign Application Priority Data

Nov. 17, 1995 [JP] Japan ..... 7-299693

[51] Int. Cl.[6] ..... G03G 15/00

[52] U.S. Cl. ..... 399/16; 271/265.04

[58] Field of Search ..... 399/45, 16, 18, 399/23, 68; 271/3.15, 265.01

[56] References Cited

U.S. PATENT DOCUMENTS 5,189,470 2/1993 Matsuda et al. ..... 399/68

*Primary Examiner*—S. Lee

*Attorney, Agent, or Firm*—Antonelli, Terry, Stout, & Kraus, LLP

[57] ABSTRACT

An electrophotographic apparatus for transferring a toner image formed on a photosensitive drum onto a sheet of paper and melt-fixing the toner image on the sheet of paper, having a paper detector at a predetermined position in a transporting path of the sheet of paper, the paper detector being composed of a light projector, a reflecting member for reflecting a primary light beam emitted from the light projector and a light receiver for sensing a secondary light beam reflected by the reflecting member, to prevent erroneous detections the light receiver is placed at a position relatively displaced with respect to a position where the light projector is located so that the primary light beam and the secondary light beam have tilting components to both a plane parallel to a transporting plane of the sheet of paper and a plane vertical to the transporting plane.

8 Claims, 5 Drawing Sheets

ELECTROPHOTOGRAPHIC APPARATUS AND PAPER DETECTOR THEREOF AND PAPER DETECTING METHOD THEREOF

BACKGROUND OF THE INVENTION

The present invention relates to an electrophotographic apparatus and a paper detector for use in the electrophotographic apparatus; and, more particularly, the invention relates to a paper detector which is suitable for use in an electrophotographic apparatus using a continuous sheet of paper.

A most basic construction of a paper detector consists of a light projector and a light receiver arranged on a straight line on opposite sides of a sheet of paper, whereby the presence or absence of the sheet of paper between the light projector and the light receiver is detected. However, in a case where a sheet of paper having holes, such as holes for filing or holes for binding, is transported, light from the light projector may pass through the holes and reach the light receiver. Therefore, there has been a disadvantage in such a paper detector in that erroneous detection occurs by incorrectly judging that the tail end of a sheet of paper is passing through the detection position.

As a countermeasure for such a problem with a paper detector of this type, the light projector 31 and a light receiver 32 can be arranged in spaced horizontal positions (or in spaced vertical positions) on one side of the paper 7, as shown in FIG. 6, and a reflecting member 33, such as a mirror, placed on the opposite side of the paper 7 with respect to the light projector 31 and the light receiver 32. Paper detection is performed in such an arrangement using two light beams, including a primary light beam L1 emitted from the light projector 31 and a secondary light beam L2 reflected by the reflecting member 33 to the light receiver 32.

Further, as a paper detector which is able to cope with various kinds and various shapes of print sheets of paper and continuous account sheets, in order to prevent erroneous detection, the number of light beams interrupted by the sheet of paper can be increased by providing a plurality of paper detectors stacked in a vertical direction (or in a lateral direction), as shown in FIG. 7. Each of these detectors consists of a light projector 31, a light receiver 32 and a reflecting member 33.

However, in the paper detector shown in FIG. 6, both the primary light beam L1 and the secondary light beam L2 are aligned horizontally, as shown in FIG. 8. Therefore, when sheets of paper 7, such as various kinds and various shapes of print sheets of paper and continuous account sheets, are used, the two light beams can pass through a single through-hole of longitudinally oblong shape or laterally oblong shape, or through two through-holes aligned longitudinally or laterally. As a result, it is likely that accurate paper detection becomes difficult and the maintenance cost is increased.

On the other hand, in a multistage paper detector of the type shown in FIG. 7, which represents a countermeasure against erroneous detection, the function is clearly improved, since the paper detector has four or more light beams. However, there is a disadvantage in that the material cost, the assembling cost and the adjusting cost are increased and the control becomes complex, and in addition to these factors, the reliability is decreased by possible occurrence of light axis displacement during operation or failure of one or more of the parts.

Further, neither of the above mechanisms provides any preventive measures against reproduction of erroneous detection, and accordingly special type sheets of paper which tend to cause erroneous detection cannot be used.

SUMMARY OF THE INVENTION

An object of the present invention is to provide an electrophotographic apparatus and a paper detector, and a paper detecting method for the electrophotographic apparatus, which can certainly and economically perform paper detection for various kinds and various shapes of sheets of paper and continuous accounting sheets with a high reliability.

Another object of the present invention is to provide an electrophotographic apparatus and a paper detector for use in the electrophotographic apparatus, which can prevent reproduction of erroneous detection when an erroneous detection occurs.

The object of the present invention can be attained by providing an electrophotographic apparatus for transferring a toner image formed on a photosensitive drum onto a sheet of paper and melt-fixing the toner image on the sheet of paper, which apparatus has a paper detector located at a predetermined position in a transporting path of said sheet of paper, the paper detector being composed of a light projector, a reflecting member for reflecting a primary light beam emitted from the light projector and a light receiver for sensing a secondary light beam reflected by the reflecting member, wherein the light receiver is placed at a position relatively displaced with respect to a position where the light projector is installed so that the primary light beam and the secondary light beam have tilting components to both a plane parallel to the transporting plane of the sheet of paper and a plane transverse to the transporting plane.

Another characteristic of the present invention is that the relative positions of the light projector and the light receiver of the paper detector are variable.

A further characteristic of the present invention is that the reflecting member is installed so as to have a tilting component in the vertical direction or the horizontal direction.

A still further characteristic of the present invention involves a paper detecting method in an electrophotographic apparatus having a paper detector located at a predetermined position in a transporting path of a sheet of paper, the paper detector being composed of a light projector, a reflecting member for reflecting a primary light beam emitted from the light projector and a light receiver for sensing a secondary light beam reflected by the reflecting member, the paper detecting method including the step of detecting the presence of the sheet of paper using the primary light beam and the secondary light beam, which have tilting components to both of a plane parallel to the transporting plane of the sheet of paper and a plane vertical to the transporting plane.

In the paper detector constructed as described above, both the primary light beam which is directed from the light projector to the reflecting member and the secondary light beam which is reflected from the reflecting member to the light receiver have components in the horizontal direction and the vertical direction. Therefore, it is possible to substantially reduce the probability of occurrence of erroneous detection in which both the primary light beam and the secondary light beam pass through a through hole of a laterally oblong shape or a longitudinally oblong shape, or holes aligned laterally or longitudinally. Further, for a special type sheet of paper which tends to cause erroneous detection, the positional relationship of the light projector and the light receiver can be changed and the positional relationship can be also changed to change the light path. Therefore, reproduction of erroneous detection can be eliminated.

DETAILED DESCRIPTION OF THE PREFERRED EMBODIMENTS

An embodiment of the present invention will be described in detail below with reference to the accompanying drawings. Initially, the overall construction of a laser beam printer using electrophotography and to which the present invention is applied will be described below with reference to FIG. 1.

Figure 1:
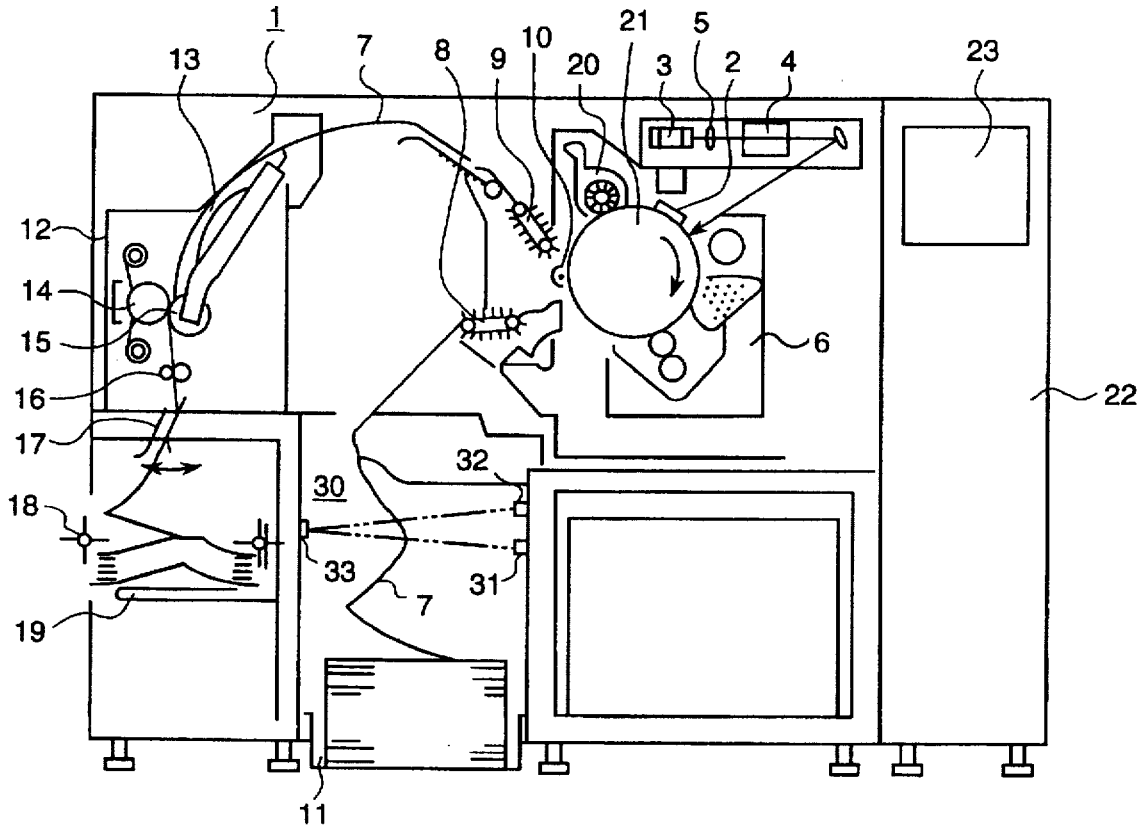
FIG. 1 is a diagrammatic view showing the overall construction of an electrophotographic apparatus having an embodiment of a paper detector in accordance with the present invention.

Referring to FIG. 1, in a laser beam printer 1, and a photosensitive drum 21 is started to rotate based on a print operation starting signal received from a controller 22. The photosensitive drum 21 rotates at a speed corresponding to a desired printing speed of the laser beam printer 1 and continues to rotate until the printing operation is completed. As the photosensitive drum 21 starts to rotate, a high voltage is applied to a corona discharger 2 and the surface of the photosensitive drum 21 is uniformly charged, for example, to a positive potential.

A rotating polygonal mirror 3 starts to rotate soon after the laser beam printer power is turned on, and is controlled to highly accurately rotate at a constant speed while the power is on. A laser beam output from a light source 4, provided in the form of a semiconductor laser or a light emitting diode, is reflected by the rotating polygonal mirror 3 and passes through an fq lens 5 to irradiate and scan on the surface of the photosensitive drum 21.

As character data and/or picture data converted into a dot image is transmitted from the controller 22 to the laser beam printer 1 as ON/OFF signals of the laser beam, portions irradiated by the laser beam and portions not irradiated by the laser beam are formed on the surface of the photosensitive drum 21. When the portion of the photosensitive drum 21 discharged by irradiation with the laser beam reaches a position facing a developer 6, positively charged toner is attracted onto the photosensitive drum 21 by action of static electricity to form a toner image on the photosensitive drum 21.

A continuous sheet of paper 7 in a paper hopper 11 is transported toward a position between the photosensitive drum 21 and a transfer unit 10 by a tractor 8 in synchronism with the timing when the toner image of the print data formed on the photosensitive drum 21 reaches the transfer position.

In order to detect the presence or absence of the sheet of paper 7 using light beams, a paper detector 30 having a light projector 31, a light receiver 32 and a mirror 33 operating as a reflecting member is installed in the middle of a transporting path of the sheet of paper 7. Information as to the presence or absence of the sheet of paper 7 detected by the paper detector 30 is transmitted to the controller 22. If the sheet of paper is absent, the printing operation of the laser beam printer 1 is stopped and a message indicating a request to supplement the paper supply is displayed on a display screen 23.

The toner image formed on the photosensitive drum 21 is attracted onto the sheet of paper 7 by the action of the transfer unit 10, which applies a charge having an opposite polarity to that of the toner image to the back side of the sheet of paper 7.

As described above, the sheet of paper 7, which has been stored in the hopper 11, is transported to a fixing unit 12 through operation of the tractor 8, the transfer unit 10 and the tractor 9.

The sheet of paper 7 which has arrived at the fixing unit 12 is preheated by a pre-heater 13 and then nipped and transported while heated and pressed by a nip unit composed of a pair of fixing rolls, including a heating roll 14 and a pressing roll 15, to melt-fix the toner image onto the sheet of paper 7. The sheet of paper 7, which is transported out by the heating roll 14 and the pressing roll 15, is transported to a stacker table 19 by a swing fin 17 and is alternatively folded along a perforated line by swing action of the swing fin 17. Thus the paper is stacked on the stacker table 19 in the folded state as arranged by a rotating paddle 18. The region of the photosensitive drum 21 which has passed through the transfer position is cleaned by a cleaning unit 20 so as to be prepared for the next printing.

Figure 2:
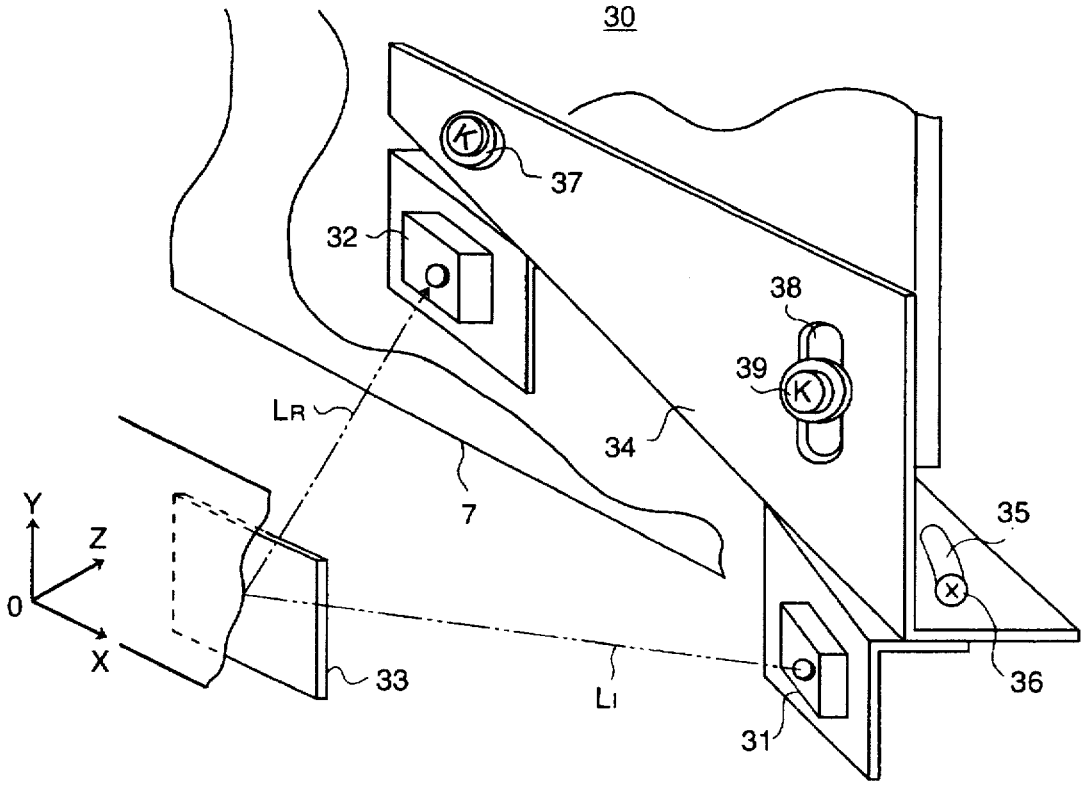
FIG. 2 is a perspective view showing an embodiment of a paper detector in accordance with the present invention.

FIG. 2 shows the detailed construction of the paper detector 30 of the laser beam printer. A light projector 31 and a light receiver 32 of the paper detector 30 are supported on a holder 34. The paper detector is constructed so that a primary light beam LI emitted from the light projector 31 is reflected by a mirror 33 so as to direct a secondary light beam LR to the light receiver 32.

When a sheet of paper does not exist in the space within the paper detector 30, the primary light beam LI emitted from the light projector 31 is reflected as a secondary light beam LR by the mirror 33 and enters the light receiver 32, and accordingly the absence of a paper sheet can be detected from the output of the light receiver 32.

On the other hand, when a sheet of paper 7 exists between the light projector 31 and the mirror 33, the primary light beam LI is interrupted by the sheet of paper 7, and the secondary light beam LR is not generated. Even if the primary light beam passes through a hole, such as a hole for filing or a hole for binding, provided in the sheet of paper, and a secondary light beam is generated, the secondary light beam will be interrupted by the sheet of paper 7 between the mirror 33 and the light receiver 32 and the light receiver 32 will not detect the secondary light beam.

As shown in FIG. 2, both the light projector 31 and the light receiver 32 are aligned nearly horizontally and are supported on the holder 34 mounted in the laser beam printer 1. The light projector 31 and the light receiver 32 are each supported so as to be rotatable in a horizontal plane around a fastening screw (not shown) as a center along an arcuate path determined by a fastening screw 36 in an elongated hole 35 in the holder 34. The angles of the light projector 31 and the light receiver 32 with respect to the holder 34 can be arbitrarily changed and a selected angle can be fixed by the fastening screw 36

Figure 3A:
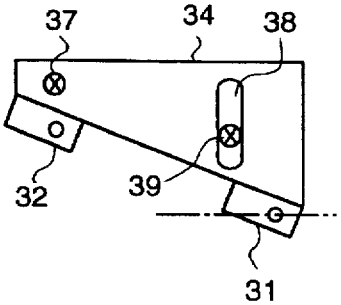
FIGS. 3(*a*) to 3(*c*) are front views showing various positions of the paper detector in accordance with the present invention.
Figure 3B:
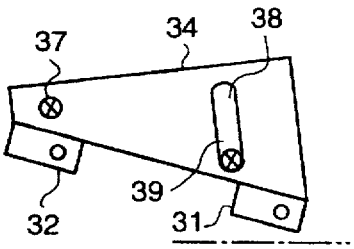
Figure 3C:
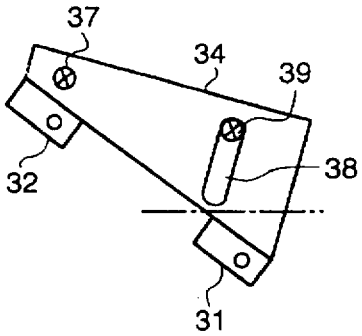

According to the present invention, in addition to this horizontal alignment, the light projector 31 and the light receiver 32 are arranged to be displaced in the vertical direction as well. As shown in FIG. 3(*a*), the holder 34 is constructed so as to rotate around a fastening screw 37 secured in the holder 34 above the light receiver 32 as a center and the holder 34 is fixed in an adjusted position to the laser beam printer 1 by a fastening screw 39. By this arrangement, the angle and the relative position H in the vertical direction of the primary light beam and the secondary light beam of the light projector 31 and the light receiver 32 can be arbitrarily varied. FIG. 3(*b*) shows a state in which the relative position H in the vertical direction is minimum, and FIG. 3(*c*) shows a state in which the relative position H in the vertical direction is maximum.

Figure 4A:
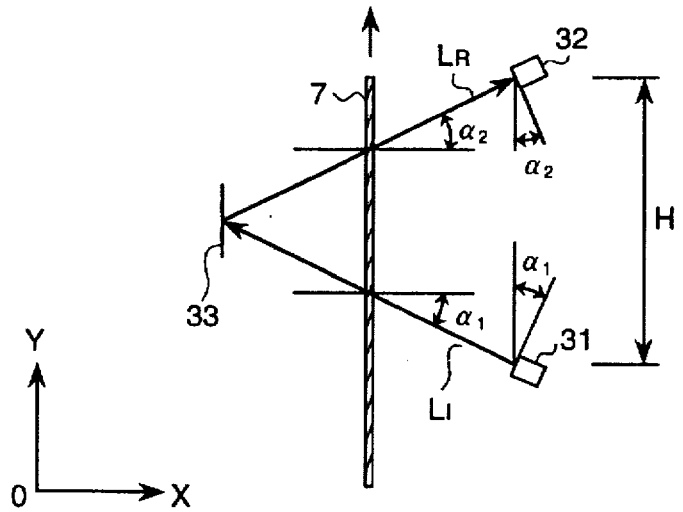
FIGS. 4(*a*) to 4(*c*) are side, top and front views, respectively, for explaining the operation of the paper detector in accordance with the present invention.
Figure 4B:
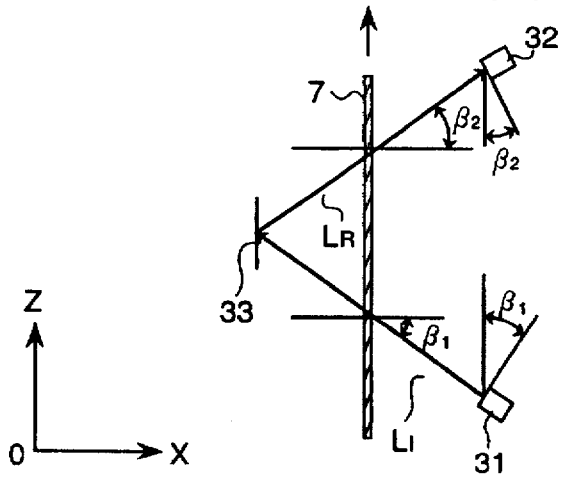
Figure 4C:
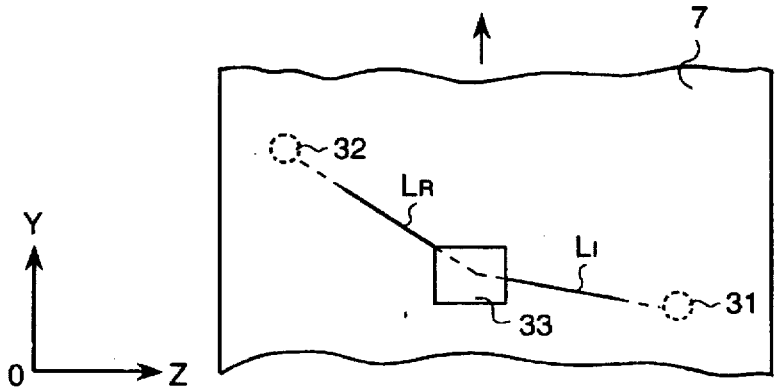

FIG. 4(*a*) is a side view of the paper detector 30, FIG. 4(*b*) is a plan view of the paper detector 30 as seen from the top and FIG. 4(*c*) is a front view of the paper detector 30. It is clear from the figures that the light projector 31 and the light receiver 32 are different in level in the vertical direction by a relative distance H. Further, the primary light beam LI and the secondary light beam LR are neither parallel to the Y-axis direction, which is parallel to the plane of the sheet of paper (that is, the transporting plane of the sheet of paper), nor parallel to the Z-axis direction, which is transverse to the Y-axis direction ($\alpha \neq 0$, $\beta \neq 0$), and accordingly they have tilting angles of $\alpha 1$, $\alpha 2$, $\beta 1$ and $\beta 2$, all of which can be individually adjusted, as described above. When the mirror 33 is placed parallel to the sheet of paper, $\alpha 1 = \alpha 2$ ($=\alpha$) and $\beta 1 = \beta 2$ ($=\beta$). It is preferable that each of the values of $\alpha$ and a is within the range of 5° to 60°.

Figure 5:
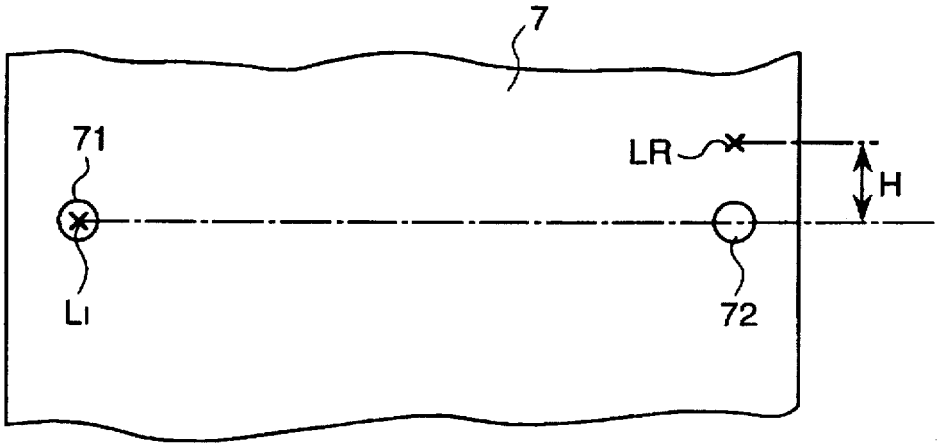
FIG. 5 is a diagram for explaining the effect of the paper detector in accordance with the present invention.
Figure 8:
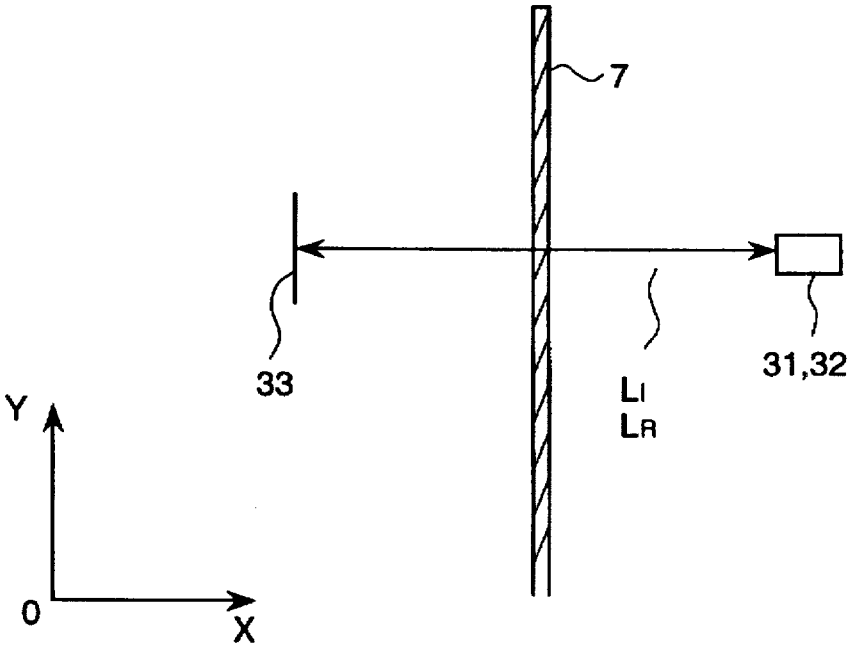
FIG.8 PRIOR ART
FIG. 8 is a diagram for explaining the operation of the conventional paper detector.
Figure 6:
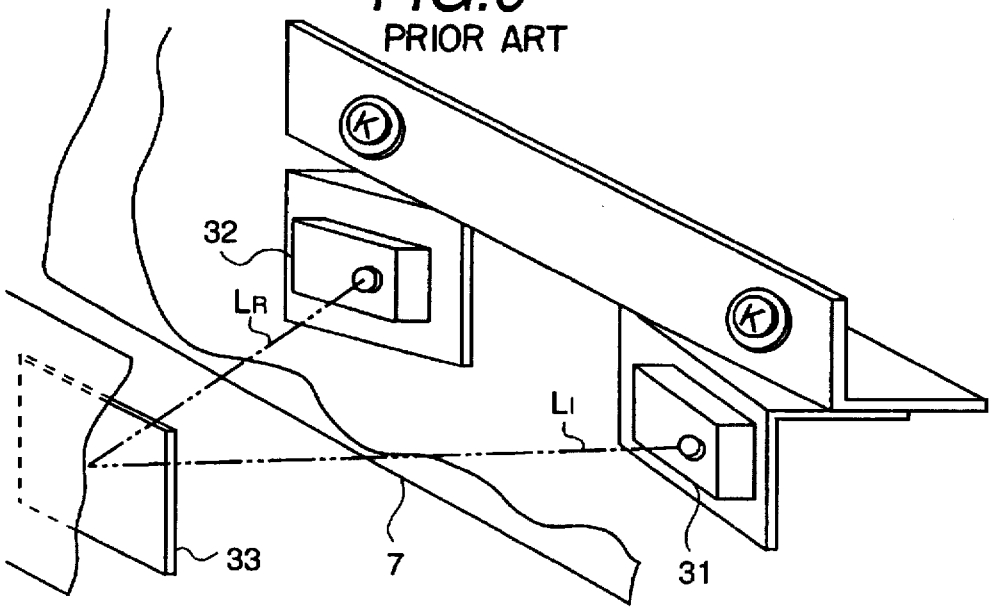
FIG.6 PRIOR ART
FIG. 6 is a perspective view showing an example of a conventional paper detector.
Figure 7:
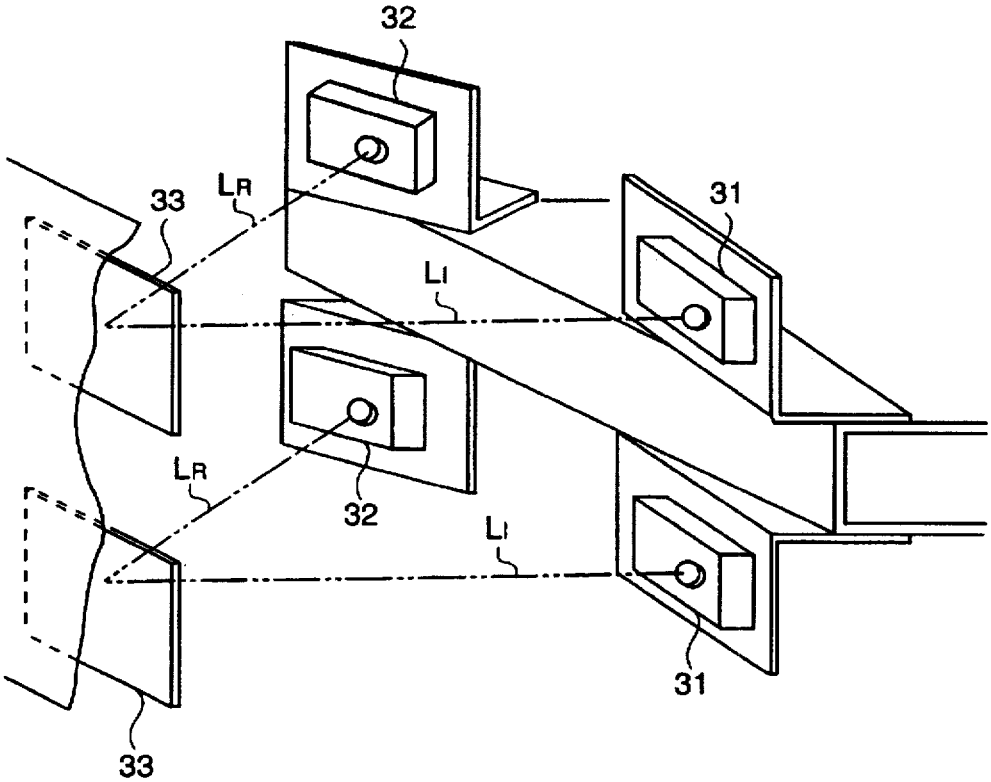
FIG.7 PRIOR ART
FIG. 7 is a perspective view showing another example of a conventional paper detector.

As described above, in this embodiment, the light projector 31 and the light receiver 32 are fixed in vertical displacement, and both the primary light beam LI and the secondary light beam LR have tilting components with respect to the plane parallel to the sheet of paper (the Y-axis direction) and also have tilting components with respect to the plane parallel to the Z-axis direction, which is transverse to the Y-axis direction. Therefore, as shown in FIG. 5, even when there are, for example, two through holes 71, 72 aligned in the horizontal direction on the sheet of paper 7, the possibility of occurrence of an erroneous detection, that is, both the primary light beam LI and the secondary light beam LR passing thorough the through holes 71 and 72, is reduced.

Further, if erroneous detection occurs, reproduction of the erroneous detection can be prevented by changing the angles and the relative position H in the vertical direction of the primary light beam and the secondary light beam of the light projector 31 and the light receiver 32.

In a case where the light projector 31 and the light receiver 32 are arranged adjacent to each other in the vertical direction, the light projector 31 and the light receiver 32 can be fixed in relative displacement in the lateral direction by applying the present invention. Thereby, since the primary light beam and the secondary light beam will have tilting components in the horizontal and the vertical directions, the same effect as in the above embodiment can be attained.

For a special type sheet of paper which may cause erroneous detection even using a light beam having a tilting component in the vertical direction (when both the primary light beam and the secondary light beam pass through the through holes), erroneous detection can be prevented by changing the angles of the primary light beam and the secondary light beam, that is, by changing the light irradiating position on the sheet of paper by changing the tilting angle of the holder 34 itself when the mirror 33 is not placed in parallel to the plane of the sheet of paper.

According to the present invention, since erroneous detection of the absence of a sheet of paper can be reduced and reproduction of erroneous detection can be prevented with nearly the same construction as in the conventional paper detector, it is possible to substantially expand the usable range of various kinds of print paper and accounting paper that can be used. Further, it is possible to reduce the maintenance cost and the cost of parts, to simplify the control, and improve the reliability of operation by decreasing displacement in the light axis and the failure of parts.

What is claimed is:

1. An electrophotographic apparatus for transferring a toner image formed on a photosensitive drum onto a sheet of paper and melt-fixing said toner image on the sheet of paper, having a paper detector at a predetermined position in a transporting path of said sheet of paper, said paper detector comprising a light projector, a reflecting member for reflecting a primary light beam emitted from said light projector and a light receiver for sensing a secondary light beam reflected by said reflecting member, wherein said light receiver is placed at a position relatively displaced with respect to a position where said light projector is located so that said primary light beam and said secondary light beam have tilting components to both a plane parallel to a transporting plane of said sheet of paper and a plane transverse to said transporting plane.

2. An electrophotographic apparatus according to claim 1, wherein relative positions of said light projector and said light receiver of said paper detector are variable.

3. An electrophotographic apparatus according to claim 1 or claim 2, wherein said paper detector further comprises a holder for holding said light projector and said light receiver at predetermined positions in such a way that installation angles of said light projector and said light receiver to said holder are arbitrarily variable, and an installation angle of said holder to said electrophotographic apparatus is variable.

4. An electrophotographic apparatus according to claim 1 or claim 2, wherein relative positions of said light projector and said light receiver are nearly horizontal, and said reflecting member is installed so as to have a tilting component in a vertical direction.

5. An electrophotographic apparatus according to claim 1 or claim 2, wherein relative positions of said light projector and said light receiver are nearly vertical, and said reflecting member is installed so as to have a tilting component in a horizontal direction.

6. A paper detector for use in an electrophotographic apparatus comprising a light projector; a reflecting member reflecting a primary light beam emitted from said light projectors a light receiver positioned to receive a secondary light beam reflected by said reflecting member; and a holder for holding said light projector and said light receiver at predetermined positions in such a way that the installation angles of each of said light projector and said light receiver to said holder are arbitrarily variable, and an installation angle of said holder to electrophotographic apparatus is variable.

7. A paper detecting method for use in an electrophotographic apparatus having a paper detector located at a predetermined position in a transporting path of a sheet of paper, said paper detector being composed of a light projector, a reflecting member for reflecting a primary light beam emitted from said light projector and a light receiver for sensing a secondary light beam reflected by said reflecting member, wherein the paper detecting method comprises the steps of:

adjusting the paths of primary light beam and the secondary light beam to have tilting components to both a plane parallel to a transporting plane of said sheet of paper and a plane transverse to said transporting plane and detecting a presence of said sheet of paper from an output of said light receiver.

8. An electrophotographic apparatus according to claim 1, further comprising means for individually adjusting tilting angles of said light projector and said light receiver relative to the transporting plane of said sheet of paper.

* * * * *